US009190069B2

(12) United States Patent
Hetherington et al.

(10) Patent No.: US 9,190,069 B2
(45) Date of Patent: Nov. 17, 2015

(54) IN-SITU VOICE REINFORCEMENT SYSTEM

(75) Inventors: Phillip A. Hetherington, Port Moody (CA); Alex Escott, Vancouver (CA)

(73) Assignee: 2236008 Ontario Inc., Waterloo, Ontario ( * ) Notice: Subject to any disclaimer, the term of this patent is extended or adjusted under 35 U.S.C. 154(b) by 2581 days.

(21) Appl. No.: 11/287,089

(22) Filed: Nov. 22, 2005

(65) Prior Publication Data

US 2007/0118360 A1 May 24, 2007

(51) Int. Cl.

*G10L 21/0208* (2013.01)
*G10L 21/0232* (2013.01)
*G10L 21/0264* (2013.01)
*G10L 21/02* (2013.01)

(52) U.S. Cl.

CPC ..... *G10L 21/0208* (2013.01); *G10L 21/0205* (2013.01); *G10L 21/0232* (2013.01); *G10L 21/0264* (2013.01)

(58) Field of Classification Search

CPC .... H04R 3/005; H04R 2499/11; H04R 1/406; H04R 3/00; H04R 2420/07; H04R 2430/03; H04R 25/407; H04R 2420/05; H04R 2430/20; H04R 25/552; H04R 5/027; H04R 5/04; H04R 2201/401; H04R 2201/403; H04R 2225/41; H04R 2410/05; H04R 2430/23; H04R 2460/13; H04R 2499/13; H04R 1/083; H04R 1/1083; H04R 1/1091; H04R 2410/01; H04R 2410/07; H04R 2430/21; H04R 2430/25; H04R 25/356; H04R 25/40; G10L 21/0208; G10L 21/0264; G10L 2025/937; G10L 25/48; G10L 21/0232; G10L 21/0205

USPC ..... 381/91–92, 122, 356

See application file for complete search history.

(56) References Cited

U.S. PATENT DOCUMENTS

| | | | | |
|---|---|---|---|---|
| 4,831,656 | A * | 5/1989 | Southern et al. | 381/361 |
| 5,890,072 | A * | 3/1999 | Rabe | 455/550.1 |
| 6,408,080 | B1 * | 6/2002 | Koizumi | 381/160 |
| 6,993,480 | B1 * | 1/2006 | Klayman | 704/226 |
| 7,031,474 | B1 * | 4/2006 | Yuen et al. | 381/1 |
| 7,110,951 | B1 * | 9/2006 | Lemelson et al. | 704/270 |
| 2003/0035552 | A1 * | 2/2003 | Kolano et al. | 381/77 |
| 2003/0101048 | A1 * | 5/2003 | Liu | 704/208 |
| 2003/0216907 | A1 | 11/2003 | Thomas | |
| 2004/0202336 | A1 * | 10/2004 | Watson et al. | 381/92 |
| 2004/0208333 | A1 * | 10/2004 | Cheung et al. | 381/333 |
| 2005/0086058 | A1 * | 4/2005 | Lemelson et al. | 704/270 |
| 2006/0088173 | A1 * | 4/2006 | Rodman et al. | 381/92 |

OTHER PUBLICATIONS

"Synth Secrets, Part 4: of Filters and Phase Relationships," Sound on Sound, Aug. 1999.*

* cited by examiner

*Primary Examiner* — Angela A Armstrong
(74) *Attorney, Agent, or Firm* — Brinks Gilson & Lione

(57) ABSTRACT

A voice reinforcement system extracts a portion of a converted speech signal and redirects it towards a listening area where it may be added with the original signal. The system includes a speech input, a filter, and a converter. The speech input generates an intermediate signal from a speech signal. The filter extracts a portion of the signal extending above a cutoff frequency. The converter converts the filtered signal to an aural signal directed towards a listening area.

24 Claims, 9 Drawing Sheets

IN-SITU VOICE REINFORCEMENT SYSTEM

BACKGROUND OF THE INVENTION

1. Technical Field

This invention relates to speech intelligibility, and more particularly, to a system that isolates and reinforces speech sounds.

2. Related Art

Speech reinforcement systems may be used to improve communication. The intelligibility of human speech may be based on consonant sounds. When these sounds are masked or are not heard by a listener, the listener's ability to comprehend the speech may be impaired.

Speech recognition systems process input voice signals. These signals may be redirected to a listener or a group of listeners to help them understand the speech. Some systems redirect an entire voice signal to an intended listener. As a result, these systems may produce feedback. To prevent feedback, special algorithms may need to further process the signals. These algorithms may create delays that diminish the intelligibility of the signal. Therefore, a need exists for an improved voice reinforcement system.

SUMMARY

A voice reinforcement system extracts a portion of a converted speech signal and redirects it towards a listening area where it may be added with the original signal. The system includes a speech input, a filter, and a converter. The speech input generates an intermediate signal from a speech signal. The filter extracts a portion of the signal extending above a cutoff frequency. The converter converts the filtered signal to an aural signal directed towards a listening area.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

A voice reinforcement system may isolate and reinforce a portion of a speech signal. Human speech may be formed through vowels and consonants. Vowels may contribute to the overall power of speech, while consonants may contribute to the intelligibility of speech. By substantially isolating and adding the consonant sounds to the original speech signal, the voice reinforcement system may improve intelligibility.

Figure 1:
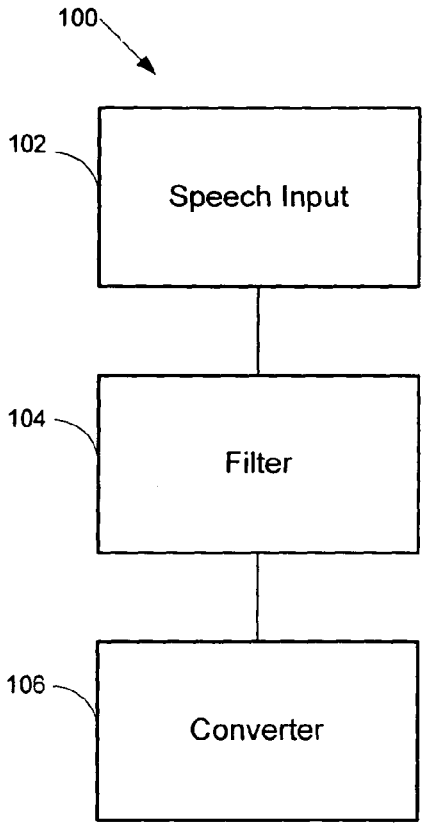
FIG. 1 is a partial block diagram of a voice reinforcement system.

FIG. 1 is a block diagram of an apparatus 100 that reinforces speech. The voice reinforcement system 100 includes a speech input 102 that receives voiced and unvoiced speech. Speech input 102 processes an input speech signal and converts it into an intermediate signal. The intermediate signal may comprise an electrical signal having amplitude that varies with detected pressure changes.

Speech input 102 may include a diaphragm, ribbon, plate, or other movable media that detects sound waves. The movement of the media may convert a mechanical energy into an electrical or optical energy. In FIG. 1, speech input 102 may generate an electrical or optical energy that represents a sound wave or parameters of the sound. This energy may be an intermediate signal. The intermediate signal is then processed by hardware and/or software that selectively pass elements of a signal while substantially eliminating or minimizing others. In FIG. 1, a filter 104, attenuates or dampens certain frequencies below a cutoff frequency. The cutoff frequency may be in the range of about 2000 Hertz (Hz) to about 4000 Hz. The filter 104 may be either an analog or digital filter (which may include a digital to analog converter). Converter 106 may covert the filtered portion of the intermediate signal into an aural signal that may be heard by an intended listener.

Converter 106 may convert an electrical or optical energy into sound waves. In FIG. 1, converter 106, may comprise an enclosure containing a metal or foil ribbon stretched between a plurality of magnets or metal sheets. The filtered portion of the intermediate signal may be received by the converter 106 which may output an aural signal.

To improve the intelligibility of the original speech signal, the aural signal may be directed towards a listening area where the crests and troughs of the aural signal's waves may be added to portions of the original speech signal's waves. The listening area may be a location where one or more listeners hear the aural signal while others proximate to the listening area may not hear the signal. To minimize echoes or distortion the delay between the original speech signal and voice reinforcement signal may be limited to a predetermined range or time period, such as about 10 ms.

Figure 2:
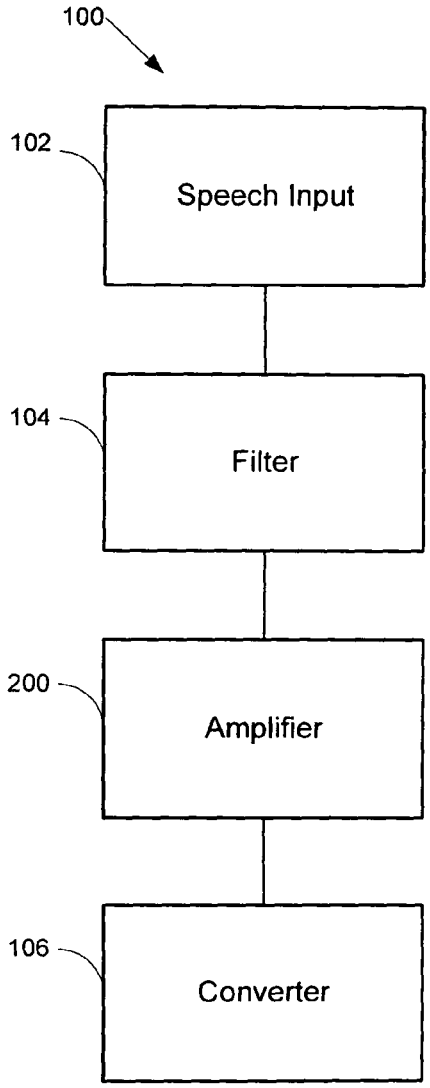
FIG. 2 is a second partial block diagram of a voice reinforcement system.

The filtered portion of the intermediate signal may be processed by hardware and/or software that increases or decreases the signal's strength. In FIG. 2, an amplifier 200, may increase or decrease the magnitude of the filtered intermediate signal. Amplifier 200 may receive and amplify the filtered portion of the intermediate signal through a static or variable gain. The gain may be automatically controlled. Once amplified, the amplified filtered portion of the intermediate signal may be passed to the converter 106 to generate the aural signal. Alternatively, the gain may be manually controlled through an analog or digital control.

Figure 3:
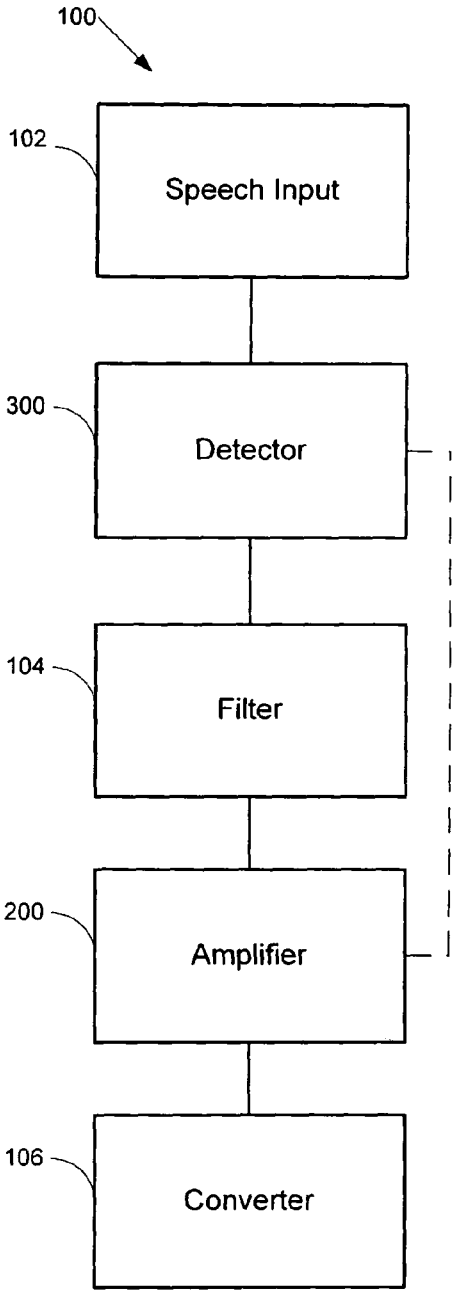
FIG. 3 is a third partial block diagram of a voice reinforcement system.

The amplifier gain may be automatically configured based on an amount of estimated or detected noise proximate to the voice reinforcement system. In FIG. 3, a detector 300 may be a noise detector that detects or estimates an underlying continuous noise. This noise may include ambient noise, in real or in a delayed time no matter how complex or loud the incoming signal may be. Additionally, the detector 300 may determine a signal to noise ratio based on the amplitude of the speech signal and the amplitude of the detected noise. To overcome the detected or estimated noise, detector 300 may communicate with amplifier 200 through automatic gain logic. The automatic gain logic may receive the detected noise level as an input and adjust the amplifier's 200 gain automatically such that an aural signal exceeds the detected or estimated noise level. In some apparatuses the amplifier's 200 gain may be manually overridden through an analog or digital control.

Figure 4:
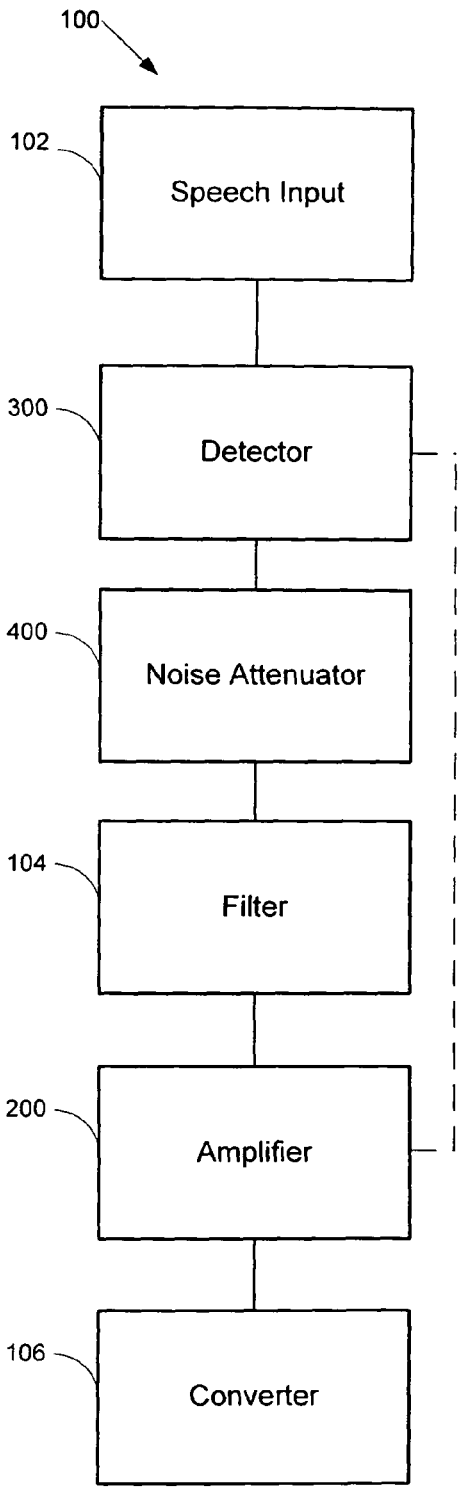
FIG. 4 is a fourth partial block diagram of a voice reinforcement system.

To improve the intelligibility of the reinforced signal, hardware and/or software may be used to increase the signal quality of the input signal. In FIG. 4, a noise attenuator 400 may process the intermediate signal to substantially remove or dampen a continuous noise that may reduce the clarity of the speech signal. Some systems that may dampen or substantially remove the continuous noise include systems that use a signal and a noise estimate such as: (1) systems which use a neural network mapping of a noisy signal and an estimate of the noise to a noise-reduced signal, (2) systems which subtract the noise estimate from a noisy-signal, (3) systems that use the noisy signal and the noise estimate to select a noise-reduced signal from a code-book, (4) systems that in any other way use the noisy signal and the noise estimate to create a noise-reduced signal based on reconstruction of the masked signal.

Some voice reinforcement systems are capable of using different types of speech inputs 102. A carbon, dynamic, ribbon, condenser, directed, or boundary microphone may be used to receive the speech signal and create the intermiediate signal. Additionally, a microphone array, arranged linearly or in a matrix formation comprising rows or columns of microphones may be used. To improve the quality of the received speech signal, speech input 102 may use a directive polar pattern to receive a substantial portion of the input signal from a specified area while substantially rejecting or dampening signals outside of the same specified area. The shapes of these directive polar patterns may include cardioids (e.g., heart shaped), hypercardioids (e.g., heart shaped with a small side lobe), bi-directional (e.g., figure-eight shaped with sensitive areas extending along the main axis), and/or shotgun (e.g., sensitive along the main axis but possessing pronounced extra side lobes that may vary with frequency).

Alternative configurations may also be used for converter 106. These configurations may include a cone attached to a coiled wire which may freely move inside a magnetic field; a loudspeaker, designed to reproduce low, mid-range, or high frequencies (e.g., comprising woofers, tweeters, or squawkers, respectively) or any combination thereof; a directive speaker; a planar speaker; an electrostatic speaker, or any sound source that modulates a medium such that the air surrounding the source emits an aural sound.

In some voice reinforcement systems, consonant sounds that have been substantially isolated may be redirected towards a listening area such that the crests and troughs of a continuously varying aural signal arrive at substantially the same time as corresponding portions of the original speech signal (e.g., in-phase or substantially in-phase). Converter 106 may generate the continuously varying aural signal.

Figure 5:
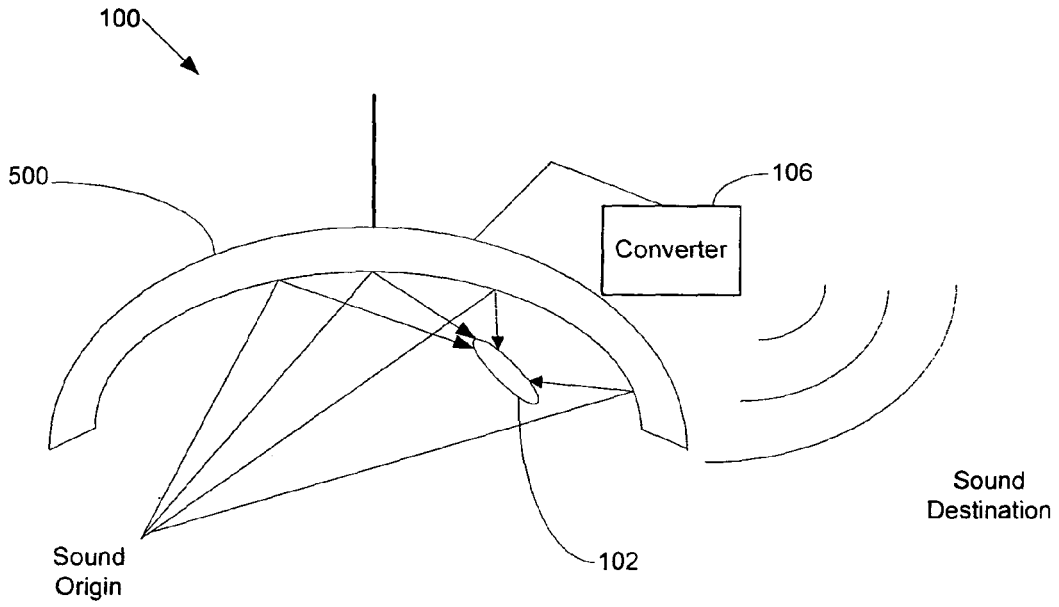
FIG. 5 is a configuration of a voice reinforcement system.

FIG. 5 illustrates an exemplary voice reinforcement system 100. A sound origin, speech input 102, filter (not shown), converter 106, and a sound destination are positioned within a common area. The voice reinforcement system 100 may be suspended near a point of sale (e.g., a retail store's cash register location) or within a vehicle compartment. In FIG. 5, the speech input 102 is suspended below a concave parabolic surface 500, such as a lighting fixture or baffle designed to deflect sound. The concave parabolic surface 500 resembles a semi-cylindrical arched structure (e.g., a barrel-vault shape). The speech input 102 may be in the proximity of the sound origin. As shown, the speech input 102 is positioned in the sound path traveling from the sound origin as well as the reflective sound path originating from the concave parabolic surface 500. The speech input 102 may be positioned at or near a focal point where the sound wave received at speech input 102 may comprise a composite signal of the sound waves representing the speech signals generated at the sound origin. As shown, the converter 106 is coupled to the exterior surface of the concave parabolic surface 500 with its output directed towards the sound destination (e.g., a listening area). In some systems, the concave parabolic surface 500 may redirect portions of sound waves representing the speech signals generated at the sound origin towards a listening area.

Figure 6:
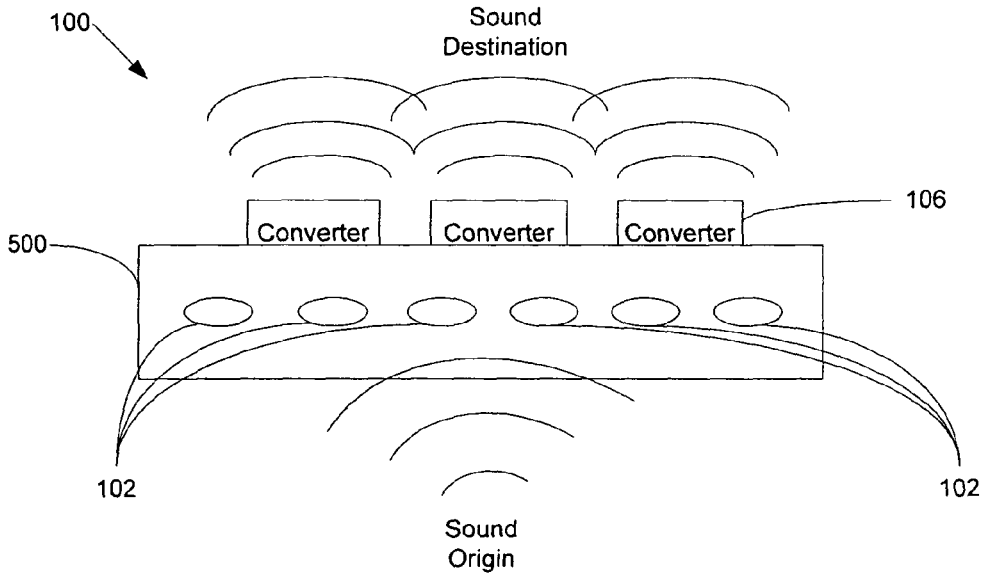
FIG. 6 is a bottom plan view of a voice reinforcement system.

FIG. 6 is a bottom plan view of voice reinforcement system 100. A plurality of spaced apart speech inputs 102 are suspended below the concave parabolic surface 500. The plurality of speech inputs 102 may be in the proximity of a sound origin. As shown, the plurality of speech inputs 102 are positioned such that some or all of the speech inputs 102 are in or near a sound path of the original sound while some or all of the plurality of speech inputs 102 are in a reflected sound path originating from the concave parabolic surface 500. The voice reinforcement system 100 may exploit the lag time from direct and reflected signals arriving at different speech inputs 102 that are positioned apart. The voice reinforcement system 100 may also include control logic that automatically selects the individual speech input 102 delivering the closest signal (e.g., voiced and/or unvoiced signal). To aid in the reinforcement of the input signal, a plurality of noise detectors 300 may be used to analyze the input of each speech input. A mixing of one or more channels may occur by switching between the outputs of the plurality of speech inputs 102. Control logic may combine the output signals of the noise detectors 300 to achieve a signal with an increased signal to noise ratio.

As shown in FIG. 6, a plurality of converters 106 may be attached to the exterior surface of the concave parabolic surface 500; the plurality of converters 106 used to direct an aural or speech signal towards a listening area. To ensure that each of the plurality of converters 106 receives the filtered portion of the intermediate signal at substantially the same time, the plurality of converters 106 may have a common input terminal (e.g., connected in parallel). The plurality of converters 106 may be arranged linearly or in a matrix layout comprising rows and columns. These converters 106 may be housed within a single enclosure, or each converter 106 may be housed within an individual enclosure. Alternatively, the plurality of converters 106 may be arranged in any of the configurations disclosed in U.S. Patent Application No. 2002/0125066, which is incorporated by reference.

Figure 7:
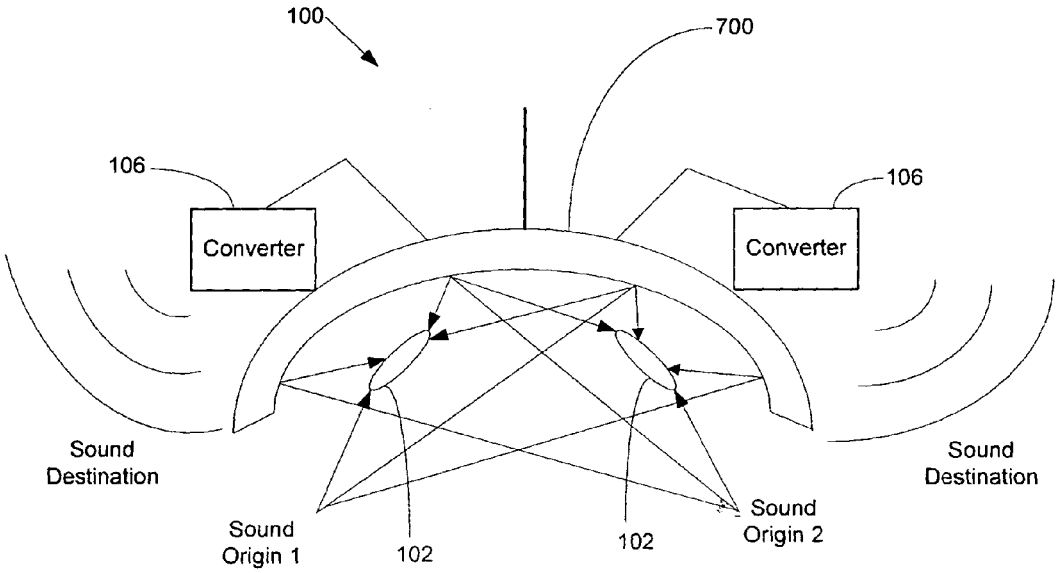
FIG. 7 is an alternative configuration of a voice reinforcement system.

FIG. 7 is an alternate voice reinforcement system 100. In FIG. 7, a plurality of voice reinforcement systems 100 may be used to improve speech intelligibility of multiple sources. Each voice reinforcement system 100 may comprise some or all of the elements described. In FIG. 7, a plurality of speech inputs 102 are arranged in an annular formation suspended or positioned beneath a concave domed spherical surface 700. The plurality of speech inputs 102 may be located in an area bounded by the interior surface of the concave domed spherical surface 700 and the horizontal plane intersecting its center point. The plurality of speech inputs 102 may be in the proximity of a sound origin. As shown, the plurality of speech inputs 102 are positioned such that some or all of the speech inputs 102 are in or near a sound path traveling from the sound origin while some or all of the plurality of speech inputs 102 are in or near a reflective sound path originating from the concave spherical surface 700. A plurality of converters 106 may be coupled to the exterior surface of the concave domed spherical surface 700. The plurality of converters 106 are oriented to direct aural sounds towards a listening area. Alternatively, the input speech signals may be received by a single speech input 102 positioned at the center point of the concave domed spherical surface 700. In some systems, the concave domed spherical surface 700 may redirect portions of sound waves representing the speech signals generated at the sound origin towards a listening area.

Some voice reinforcement systems position speech input 102 in-line with or below a sound origin and in front of other reflecting boundaries. This may occur where a retail countertop and a surface of a cash register meet, or on or near a vehicle's rearview mirror in front of the windshield. This placement, between the sound origin and a reflecting boundary, may result in a double boundary effect, where the speech input 102 receives both direct and immediately reflected speech signals. The reflected signals which bounce back from the reflecting boundary may be in-phase or substantially in-phase with the direct signals resulting in about a 6 decibel increase in the received signal. Converter 106 may be positioned to direct an aural or speech signal toward a listening area.

Figure 8:
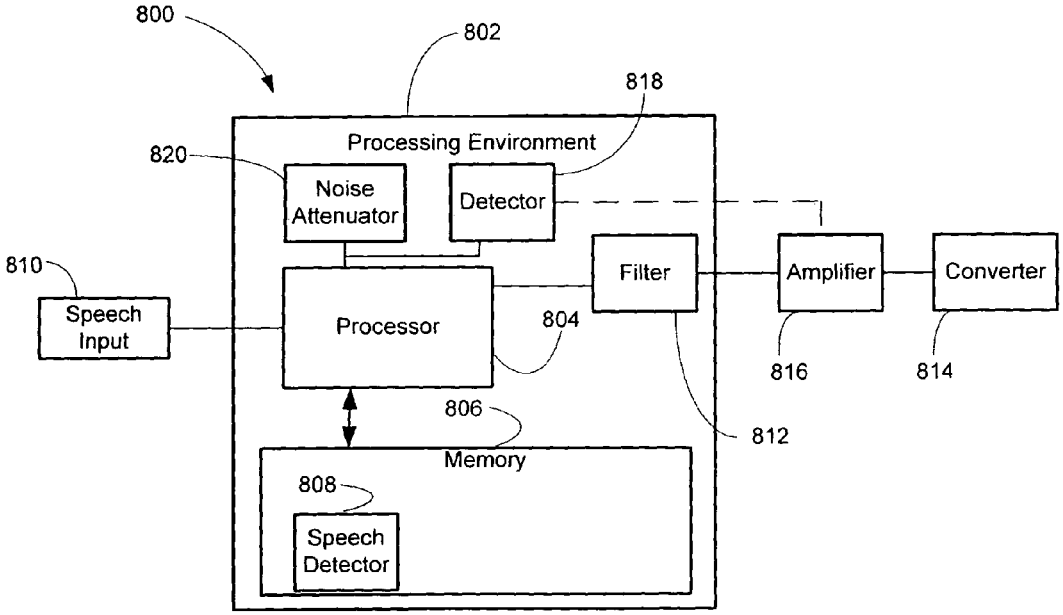
FIG. 8 is a fifth partial block diagram of a voice reinforcement system.

FIG. 8 is another partial block diagram of an apparatus 800 that reinforces speech signals. In some systems, the voice reinforcement apparatus 800 may encompass hardware or software that is capable of running on one or more processors in conjunction with one or more operating systems. The voice reinforcement system 800 may include a processing environment 802, such as a controller or computer. The processing environment 802 may include a processor 804 and a memory 806. The processor 804 may perform logic and/or control operations by accessing memory 806 via a bidirectional bus. The memory 806 may store portions of an input speech signal. Some memory 806 may store speech detection code or interface a speech detection module 808 to detect speech input. Additionally, memory 806 may store buffered speech signal data obtained during the voice reinforcement system's 800 operation. Processor 804 is linked to a speech input 810, which converts an input voiced or unvoiced signal into an intermediate signal. Additionally, processor 804 may execute a beamformer algorithm which may exploit the lag time from direct and reflected signals arriving at different speech inputs 810 that are positioned apart. The processor 804 is also linked to a filter 812. Filter 812 may be configured to substantially pass a portion of the intermediate signal extending above a cutoff frequency. The cutoff frequency may be in the rage of about 2000 Hz to about 4000 Hz. Filter 812 may be either an analog or digital filter (which may include a digital to analog converter) and may be unitary to the processing environment 802 or interface the processing environment with a separate device. Filter 812 may communicate with converter 814 which may be configured to convert a filtered intermediate signal into an aural signal directed towards a listening area. Processor 804 may be suitably programmed to disable converter 814 during periods in which speech detection module 808 detects non-voice signals or substantially non-voice signals.

Optional components of voice reinforcement system 800 may include an amplifier 816, a detector 818, and/or a noise attenuator 820. Some or all of these components may be unitary to the processing environment 802 or interface the processing environment with separate devices. The amplifier 816, detector 818, and noise attenuator 820 may be configured as described. Processor 804 may be programmed to execute the acts shown in the flowcharts of FIGS. 9-12.

Figure 9:
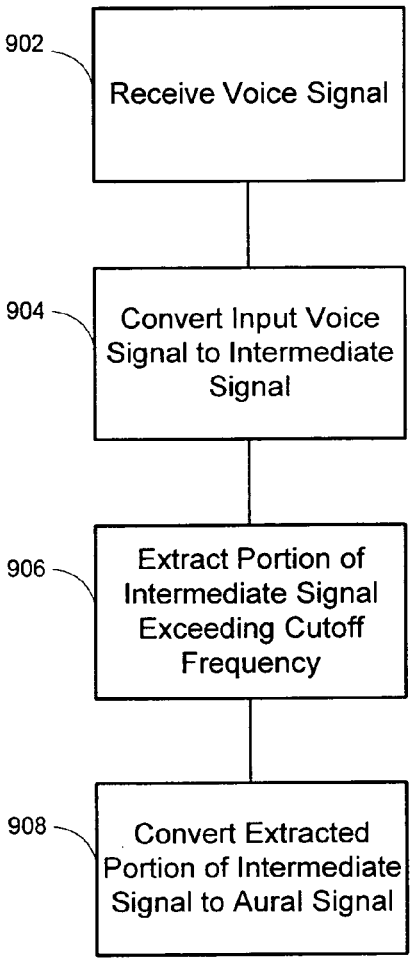
FIG. 9 is a flowchart of a voice reinforcement system.

FIG. 9 is an exemplary flowchart of a voice reinforcement system. The system operates by receiving a speech signal, isolating portions of the speech signal, and redirecting the isolated portions of the speech signal towards a listening area where they may arrive at substantially the same time as the original speech signal. To prevent echoes or a mismatch between a listener seeing the movement of a speaker's mouth and hearing the reinforced signal, the delay between the original and reinforced signal may be limited to predetermined range or time period, such as about 10 ms.

At act 902 a speech signal is received by the voice reinforcement system. The signal may be received: (1) along or near a sound path traveling from a sound origin and a speech input, (2) along or near a reflective sound path, where the speech signal is reflected off of a reflecting surface and directed to the speech input, and/or (3) along or near a combination of these paths. At act 904 the speech signal is converted to an intermediate signal by converting the sensed air pressure levels or changes at the speech input into an electric or optical energy.

At act 906, a portion of the intermediate signal is extracted. The extracted portion of the intermediate signal may begin at a value in a desired range such as a range of about 2000 Hz to about 4000 Hz. To reinforce the speech signal, a user (e.g., listener) may adjust this range. Alternatively, the voice reinforcement system may include control logic that automatically adjusts the extraction range based on a historical analysis of the voice reinforcement system's operation.

At act 908, the extracted portion of the intermediate signal is converted into an aural signal and directed towards the sound destination. The aural signal may be generated by applying a current of the same or a related phase and amplitude of the extracted intermediate signal to a medium that will generate air pressure changes and may vibrate.

Figure 10:
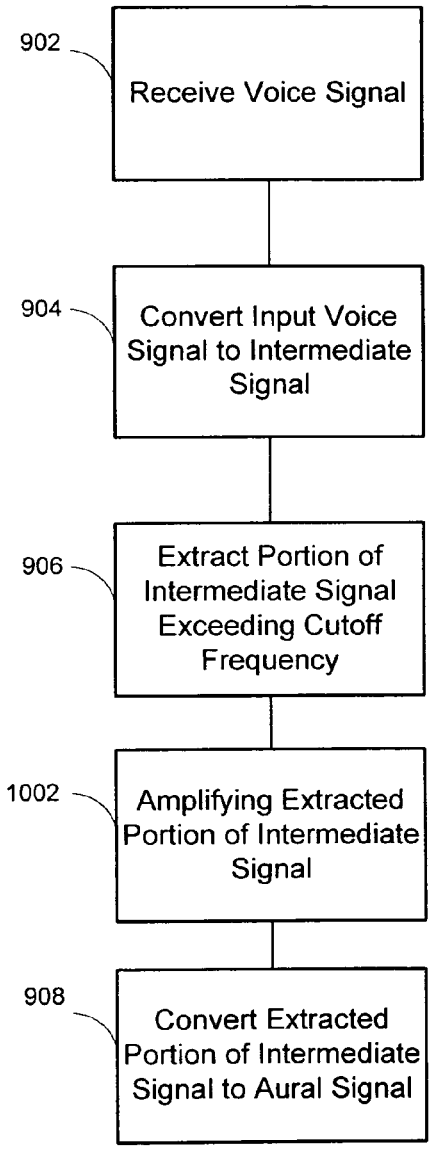
FIG. 10 is an alternate flowchart of a voice reinforcement system.

FIG. 10 is an alternate flowchart of a voice reinforcement system. At act 1002, the extracted portion of the intermediate signal may be amplified before it is received by the converter at act 908. Act 1002 may occur under manual control or automatic control, and may comprise multiplying the input signal by a static or variable gain. The signal output by the amplifier may have a larger or small magnitude than the signal received by the amplifier.

Figure 11:
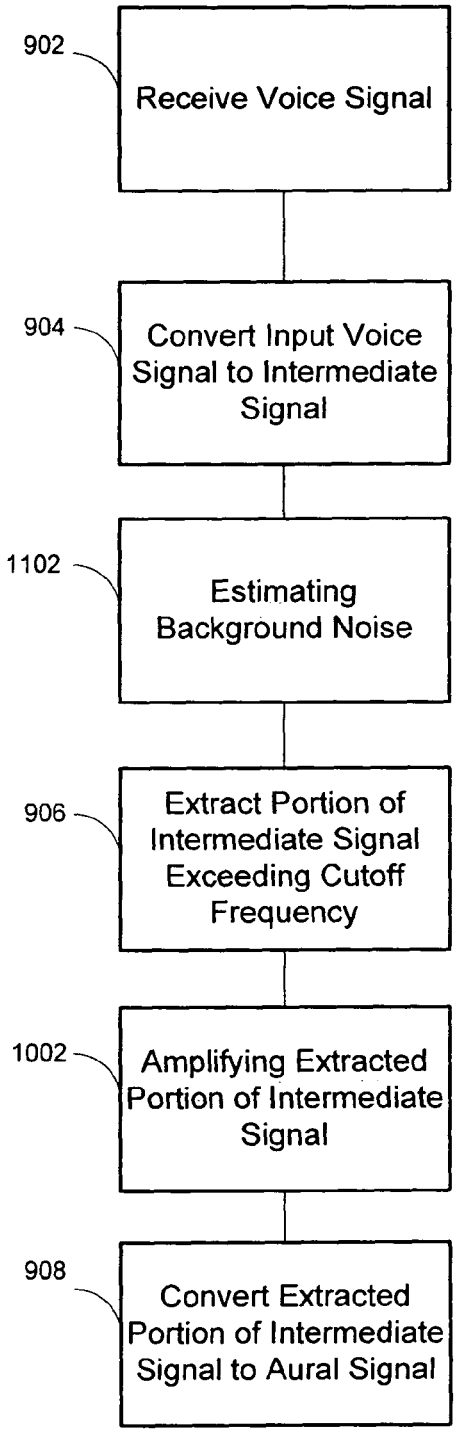
FIG. 11 is a third alternate flowchart of a voice reinforcement system.

To establish an initial gain for the amplifier, the background noise may be estimated as shown in FIG. 11 at act 1102. The background noise estimate may determine an underlying noise which may include ambient noise. Additionally, at act 1102, a signal to noise ratio may be determined based on the amplitude of the intermediate signal and the amplitude of the estimated or detected noise. The estimated background noise level may be supplied to control logic or directly to the amplifier and used to set the amplifier's gain.

Figure 12:
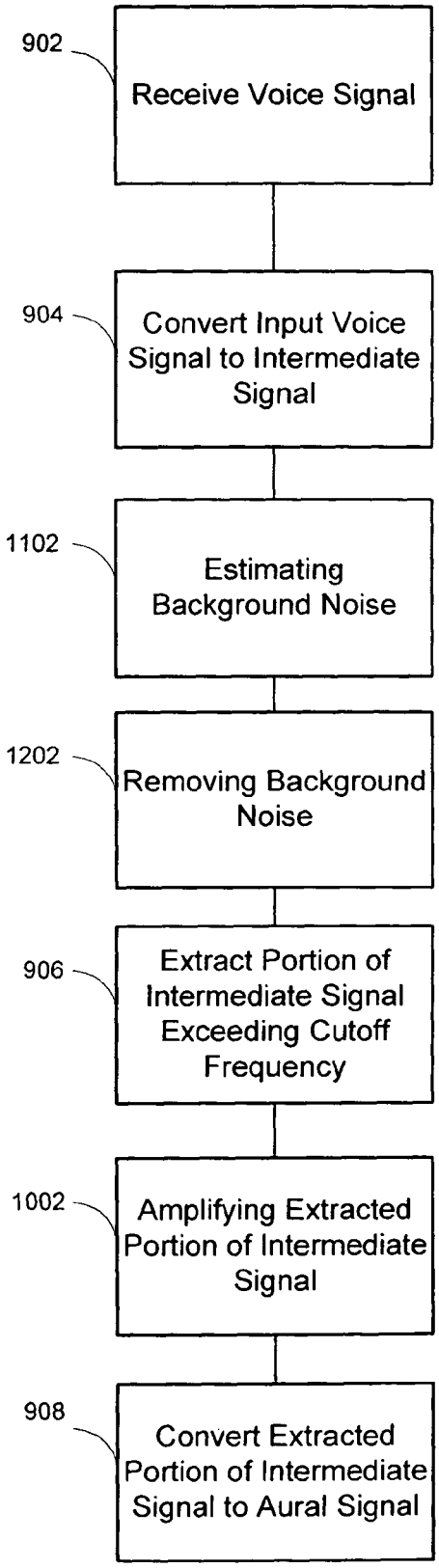
FIG. 12 is a fourth alternate flowchart of a voice reinforcement system.

FIG. 12 is an alternate flowchart for a voice reinforcement system. At act 1202 substantially all or a portion of the detected or estimated noise may be removed or dampened. Some systems may detect or estimate noise by using a voice or energy detector to distinguish a voiced signal or unvoiced signal from noise. An estimation of the noise may be continually updated during periods of non-voice. To remove or dampen substantially all or a portion of the detected or estimated noise, a spectral subtraction technique may be used, such as where an average noise spectrum is subtracted from an average signal spectrum. Alternatively, portions of the estimated or detected signal below a selected threshold may be removed, such as with a noise-gate. The noise-gate's settings, such as the threshold level or how quickly the noise-gate reacts to changes in the input signal level, may be user customizable.

Figure 13:
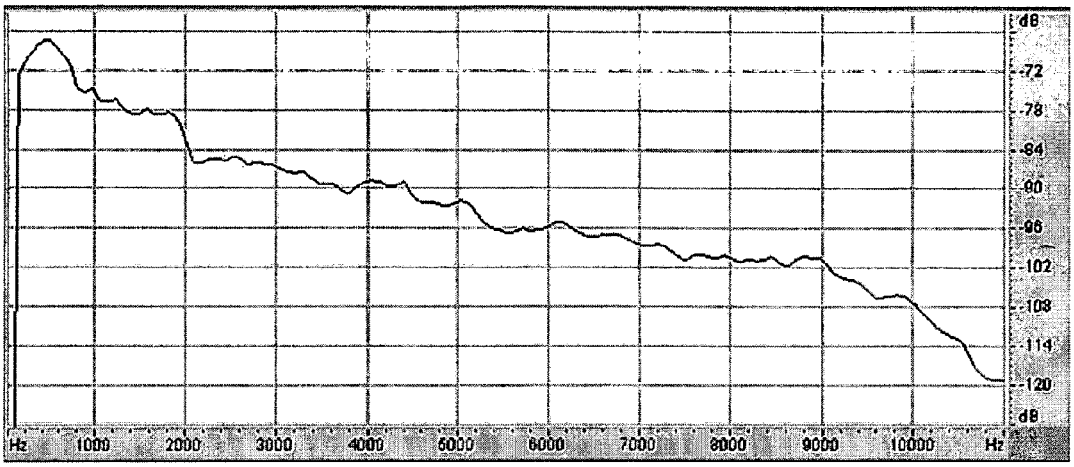
FIG. 13 is an intermediate signal.

FIGS. 13-16 are partial frequency response diagrams for a voice reinforcement system. In FIG. 13, an intermediate signal, in the frequency domain, is generated from a received input speech signal. The speech signal comprises both the vowel and consonant sounds associated with a speech segment.

Figure 14:
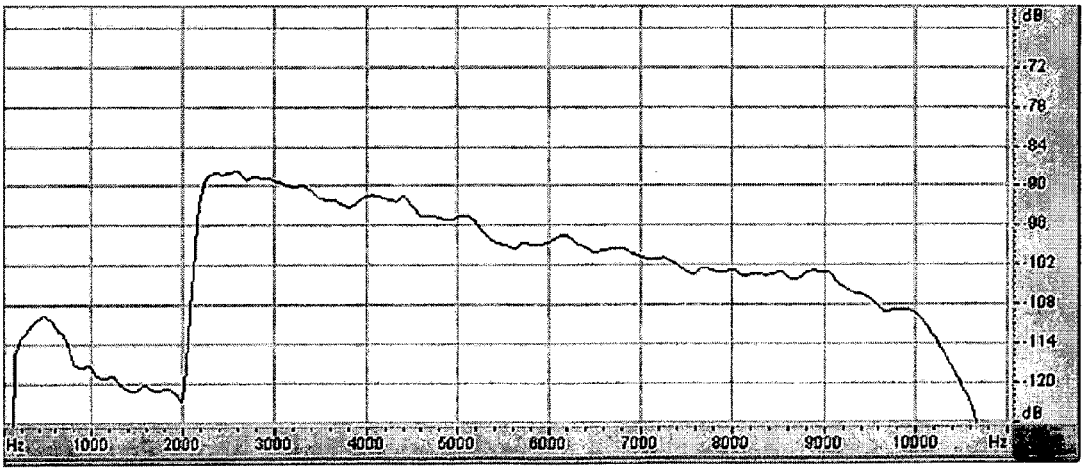
FIG. 14 is a filtered signal.

FIG. 14, illustrates an extracted portion of the intermediate signal that has been amplified by a predefined gain factor. In FIG. 14, the portion of the intermediate signal exceeding about 2000 Hz (e.g., the cutoff frequency) was extracted by a filter. The amplified signal may be generated by amplifying the extracted signal prior to inputting it to the converter. The portion of the intermediate signal below the cutoff frequency has been attenuated so that it will have little contribution when added to the original speech signal.

Figure 15:
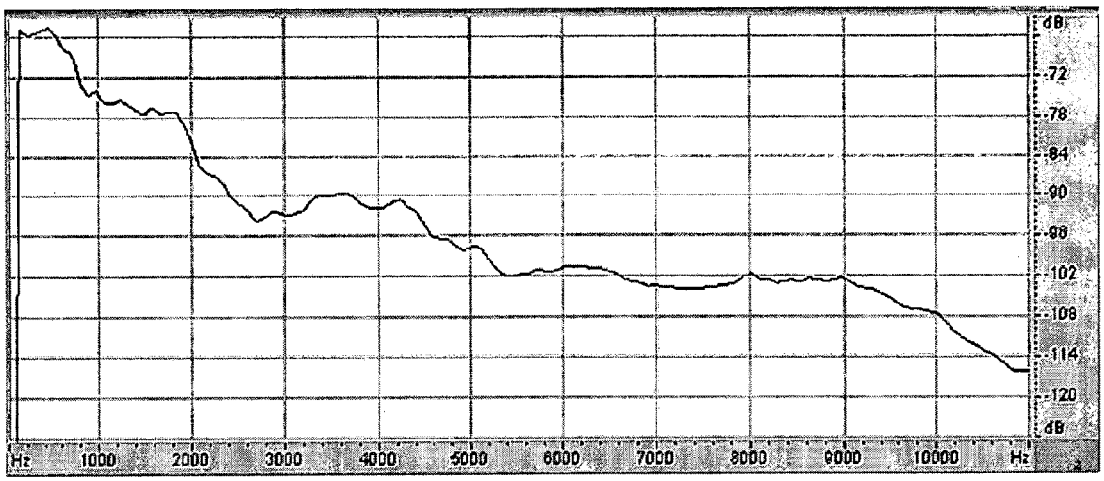
FIG. 15 is a voice signal at a sound destination.

FIG. 15 represents the original speech signal received at the sound destination. As shown, the signal has not been processed by the voice reinforcement system. This signal incorporates random and ambient noise detected near the voice reinforcement system. The speech signal comprises both the vowel and consonant portions (e.g., high frequency components) of the original signal. Because the high frequency components of the signal carry less energy, they are dissipated at a greater rate then the lower frequencies and therefore are harder to detect at the sound destination.

Figure 16:
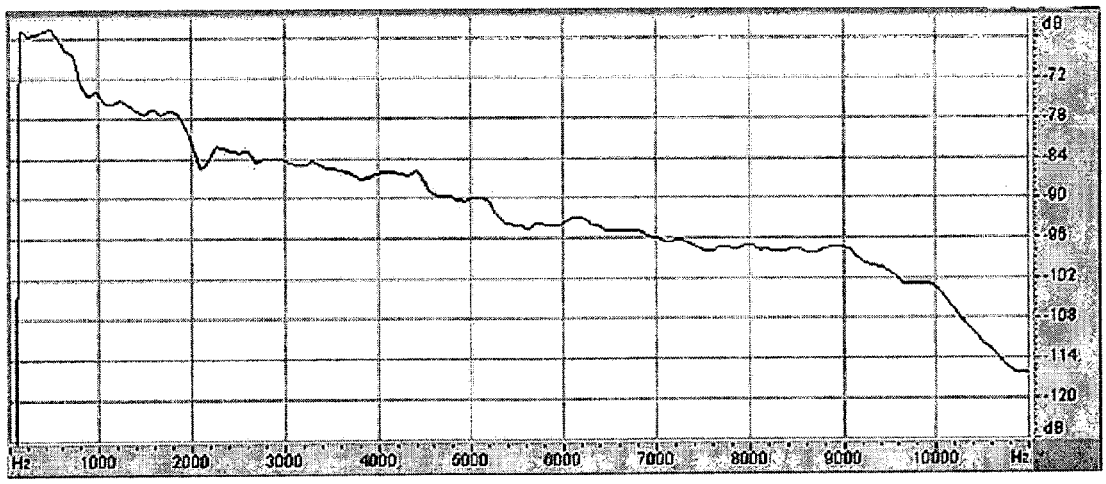
FIG. 16 is a voice reinforcement signal at a sound destination.

FIG. 16 illustrates an exemplary signal produced by a voice reinforcement system at a listening area. This signal comprises the signal created by the converter and the un-reinforced signal (e.g., the signal illustrated in FIG. 15) detected at the sound destination. The lower frequencies of this signal (e.g., less than a cutoff frequency in the range of about 2000 Hz to about 4000 Hz) may comprise the un-reinforced signal. The higher frequencies of this signal (e.g., above the cutoff frequency) may comprise the summation of the signals generated by the converter and the corresponding portions of the un-reinforced signal received at the sound destination.

Figure 17:
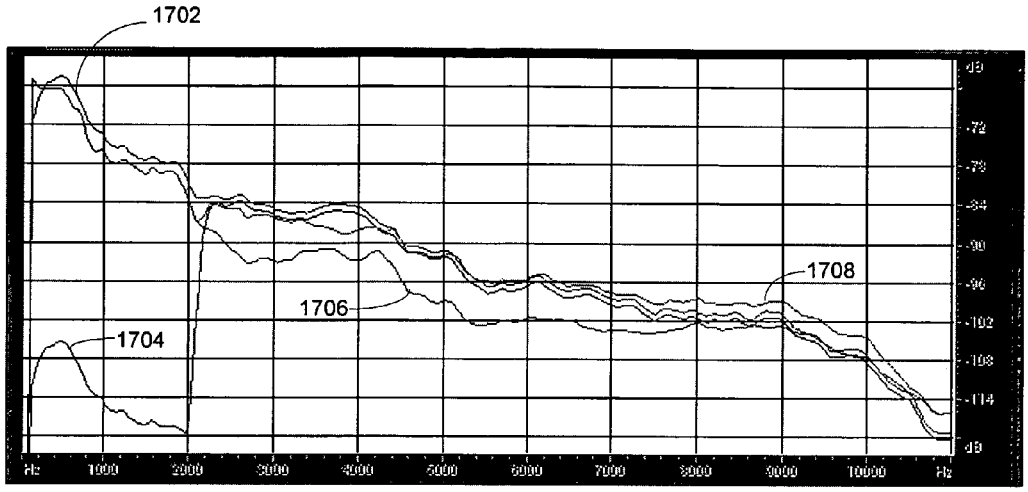
FIG. 17 is a partial frequency response diagram at different points in the system.

FIG. 17 is a partial frequency response diagram at different points in the system. Plot 1702 is the signal of FIG. 13. Plot 1704 is the signal of FIG. 14. Plot 1706 is the signal of FIG. 15. Plot 1708 is the signal of FIG. 16.

The methods shown in FIGS. 9-12 may be encoded in a signal bearing medium, a computer readable medium such as a memory, programmed within a device such as one or more integrated circuits, or processed by a controller or a computer. If the methods are performed by software, the software may reside in a memory resident to or interfaced to the processing environment 802 or any type of communication interface. The memory may include an ordered listing of executable instructions for implementing logical functions. A logical function may be implemented through digital circuitry, through source code, through analog circuitry, or through an analog source such as through an electrical, audio, or video signal. The software may be embodied in any computer-readable or signal-bearing medium, for use by, or in connection with an instruction executable system, apparatus, or device. Such a system may include a computer-based system, a processor-containing system, or another system that may selectively fetch instructions from an instruction executable system, apparatus, or device that may also execute instructions.

A "computer-readable medium," "machine-readable medium," "propagated-signal" medium, and/or "signal-bearing medium" may comprise any means that contains, stores, communicates, propagates, or transports software for use by or in connection with an instruction executable system, apparatus, or device. The machine-readable medium may selectively be, but not limited to, an electronic, magnetic, optical, electromagnetic, infrared, or semiconductor system, apparatus, device, or propagation medium. A non-exhaustive list of examples of a machine-readable medium would include: an electrical connection "electronic" having one or more wires, a portable magnetic or optical disk, a volatile memory such as a Random Access Memory "RAM" (electronic), a Read-Only Memory "ROM" (electronic), an Erasable Programmable Read-Only Memory (EPROM or Flash memory) (electronic), or an optical fiber (optical). A machine-readable medium may also include a tangible medium upon which software is printed, as the software may be electronically stored as an image or in another format (e.g., through an optical scan), then compiled, and/or interpreted or otherwise processed. The processed medium may then be stored in a computer and/or machine memory.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. A voice reinforcement system, comprising:

a reflective boundary to reflect a voice signal from a speaker toward a listening location, the listening location spaced apart from a location of the speaker;

a microphone, located between the speaker and the reflective boundary, to convert the voice signal to an intermediate electrical signal, where the microphone is spaced apart from the reflective boundary;

a filter to extract a portion of the intermediate electrical signal representing a consonant sound from the voice signal to an extracted signal, the extracted signal based on frequency content of the intermediate electrical signal;

an amplifier to amplify the extracted signal to an amplified signal; and a converter to convert the amplified signal into an audible signal that is directed toward the listening location and is substantially in-phase with a portion of the reflected voice signal to generate a reinforced signal formed from a summation of a portion of the amplified signal and the portion of the reflected voice signal.

2. The voice reinforcement system of claim 1, where the reflective boundary is a concave parabolic surface, and the microphone is suspended below the reflective boundary.

3. The voice reinforcement system of claim 2, where the microphone comprises a plurality of spaced apart microphones.

4. The voice reinforcement system of claim 2, where the converter comprises a plurality of converters.

5. The voice reinforcement system of claim 2, where a delay between the audible signal directed toward the listening location and the reflected voice signal is less than about 10 milliseconds.

6. The voice reinforcement system of claim 2, where the filter extracts a portion of the intermediate electrical signal below a cutoff frequency.

7. The voice reinforcement system of claim 6, where the cutoff frequency is between about 2000 Hertz and about 4000 Hertz.

8. The voice reinforcement system of claim 2, further comprising a noise estimator that is configured to estimate a signal to noise ratio based on the voice signal.

9. The voice reinforcement system of claim 8, where an amplifier gain is automatically controlled in response to a control signal received from the noise estimator, the signal based on the estimated signal to noise ratio.

10. The voice reinforcement system of claim 8, further comprising a noise attenuator, the noise attenuator configured to process the intermediate electrical signal to dampen continuous noise based on the estimated signal to noise ratio.

11. The voice reinforcement system of claim 2, further comprising a noise detector that is configured to detect a signal to noise ratio based on the voice signal.

12. The voice reinforcement system of claim 2, where an amplifier gain is automatically controlled in response to a control signal received from the noise detector, the signal based on the detected signal to noise ratio.

13. The voice reinforcement system of claim 11, further comprising a noise attenuator, the noise attenuator configured to process the intermediate electrical signal to dampen continuous noise based on the detected signal to noise ratio.

14. The voice reinforcement system of claim 1, where the microphone comprises a plurality of spaced apart microphones.

15. The voice reinforcement system of claim 1, where the converter comprises a plurality of converters.

16. The voice reinforcement system of claim 1, where a delay between the audible signal directed toward the listening location and the reflected voice signal is less than about 10 milliseconds.

17. The voice reinforcement system of claim 1, where the filter extracts a portion of the intermediate electrical signal below a cutoff frequency.

18. The voice reinforcement system of claim 17, where the cutoff frequency is between about 2000 Hertz and about 4000 Hertz.

19. The voice reinforcement system of claim 1, further comprising a noise estimator that is configured to estimate a signal to noise ratio based on the voice signal.

20. The voice reinforcement system of claim 19, where an amplifier gain is automatically controlled in response to a control signal received from the noise estimator, the signal based on the estimated signal to noise ratio.

21. The voice reinforcement system of claim 19, further comprising a noise attenuator, the noise attenuator configured to process the intermediate electrical signal to dampen continuous noise based on the estimated signal to noise ratio.

22. The voice reinforcement system of claim 1, further comprising a noise detector that is configured to detect a signal to noise ratio based on the voice signal.

23. The voice reinforcement system of claim 1, where an amplifier gain is automatically controlled in response to a control signal received from the noise detector, the signal based on the detected signal to noise ratio.

24. The voice reinforcement system of claim 22, further comprising a noise attenuator, the noise attenuator configured to process the intermediate electrical signal to dampen continuous noise based on the detected signal to noise ratio.

* * * * *